United States Patent [19]

Profio et al.

[11] 4,409,640

[45] Oct. 11, 1983

[54] ABORT CYCLE TIMER

[75] Inventors: Mark V. Profio, Wauwatosa; James T. Libert, Waukesha; Julian C. Kampf, Grafton, all of Wis.

[73] Assignee: Square D Company, Palatine, Ill.

[21] Appl. No.: 319,487

[22] Filed: Nov. 9, 1981

[51] Int. Cl.[3] ..... H01H 47/18

[52] U.S. Cl. ..... 361/197; 361/195

[58] Field of Search ..... 361/195, 196, 197

[56] References Cited

U.S. PATENT DOCUMENTS 3,346,779 10/1967 Enk ..... 361/195

FOREIGN PATENT DOCUMENTS 2755653 6/1979 Fed. Rep. of Germany ..... 361/197

388425 6/1965 Switzerland ..... 361/195

*Primary Examiner*—Reinhard J. Eisenzopf

*Attorney, Agent, or Firm*—Michael J. Femal; Donald P. Reynolds; Richard T. Guttman

[57] ABSTRACT

This disclosure depicts a novel abort cycle timer circuit for use with an AC source of electrical power and for operating electrical controls for machinery. The circuit provides a substantially DC voltage and current, first and second relays with normally open and normally closed contacts and a timing abort circuit. Opening a first of two switches causes the second of the two relays to energize after a time delay. Opening both switches causes the second relay to deenergize after a predetermined time. The novel circuit has improved immunity to electrical and magnetic noise.

14 Claims, 6 Drawing Figures

ABORT CYCLE TIMER

BACKGROUND OF THE INVENTION

This invention relates, in general, to abort cycle timer circuits and, more specifically, to timer circuits for use with punch press machinery. Extraneous magnetic fields exist in the industrial environment. The circuit of the present invention provides an improved immunity to extraneous magnetic fields. Moreover, this circuit achieves the above-mentioned objectives through a simpler design having fewer components and therefore costs less to manufacture.

OBJECTS OF THE INVENTION

It is a general object of the present invention to provide an improved abort cycle timer circuit.

It is a more specific object to provide a reliable timer circuit.

It is another object of the present invention to provide an abort cycle timer circuit which is generally insensitive to electrical and magnetic noise.

BRIEF DESCRIPTION OF THE DRAWINGS

Features of the present invention which are believed to be novel are set forth with particularity in the appended claims. The invention, together with further objects and advantages, may best be understood by reference to the following description taken in conjunction with the accompanying drawings, in the several figures of which like reference numerals identify like elements, and in which:

DESCRIPTION OF THE PREFERRED EMBODIMENT

Whereas the invention may be utilized with various types of equipment, it is preferably utilized in punch presses. The electrical circuit of the present invention is reliable and improves noise immunity.

In general terms, the present invention is an abort cycle timer circuit for use with an AC source of electrical power having first and second conductors and providing an AC electrical signal. The abort cycle timer circuit is used for operating electrical equipment. The circuit comprises a means for providing a substantially DC voltage and current. A first relay is provided having at least one set of normally open contacts and at least one set of normally closed contacts. The normally open contacts are connected between the means for providing a DC voltage and current and a second junction point. One of the normally closed contacts is connected to the second junction point. A first means for causing an open circuit is connected in series between the first conductor and the means for providing a DC voltage and current. A second means for causing an open circuit is connected in series with a coil of the first relay. The second means in series with the coil is connected between the first conductor and the second conductor. A timing abort means for operating a coil of a second relay is connected to the normally closed contacts of the first relay, the second junction point and the second conductor. The coil of the second relay is connected between the second junction point and the second conductor. The second relay has either one normally open and/or normally closed contacts.

The circuit further comprises a zener diode for clipping the rectified AC signal and is connected between the second junction point and the second conductor. The means for providing a DC voltage and current may be either a halfwave rectifier or a fullwave bridge.

Figure 1:
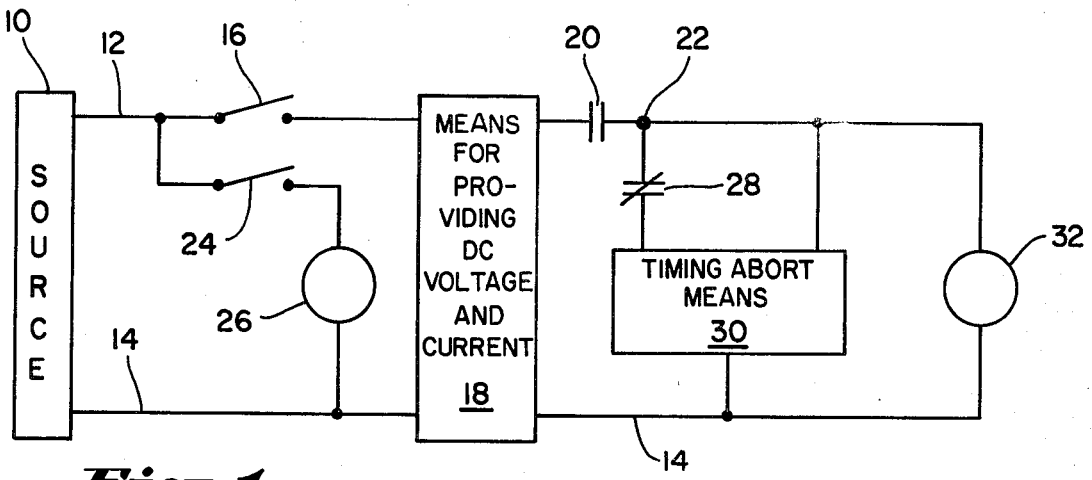
FIG. 1 is a schematic diagram of the novel invention shown partially in block form.

FIG. 1 shows a schematic diagram partially in block diagram form of the present invention. An AC source of electrical power 10 has first and second conductors 12 and 14 and provides an AC electrical signal. The first means 16 for causing an open circuit is a switch and controls the power to the means 18 for providing a DC voltage and current. The first means 16 for causing an open circuit is connected in series between the first conductor 12 and the means 18 for providing a DC voltage and current. A first relay is provided having at least one set of normally open contacts and at least one set of normally closed contacts. The normally open contacts 20 are connected between the means 18 for providing a DC voltage and current and a second junction point 22.

A second means for causing an open circuit is switch 24. It is connected in series with a coil 26 of the first relay. The switch 24 and coil 26 are connected between the first conductor 12 and the second conductor 14.

One of the normally closed contacts 28 of the first relay is connected to the second junction point 22. The timing abort means 30 for operating a coil 32 of a second relay is connected to the normally closed contacts 28 of the first relay, the second junction point 22 and the second conductor 14. The coil 32 of the second relay is connected between the second junction point 22 and the second conductor 14. The second relay has either one normally open and/or normally closed contacts. These contacts are further connected to the electrical controls of the punch press or other equipment which the abort cycle timer circuit operates.

Figure 2:
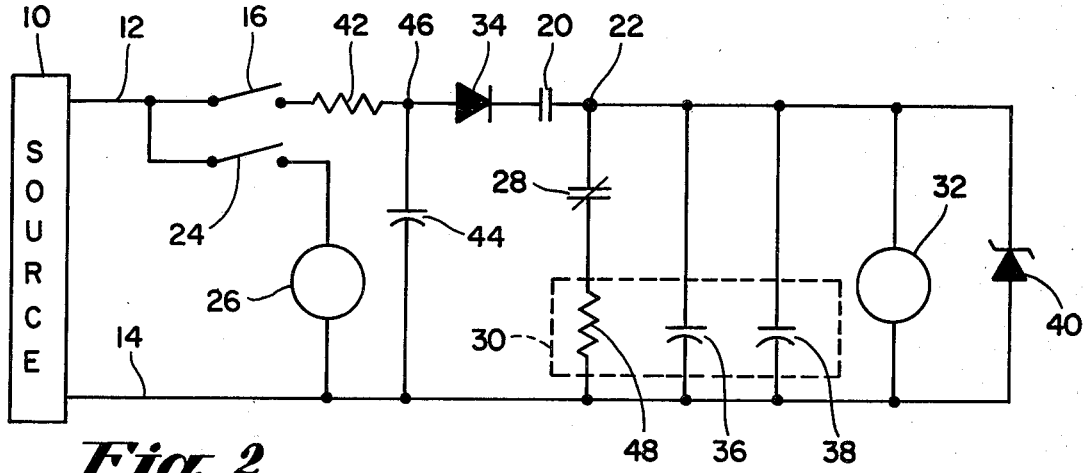
FIG. 2 is a schematic drawing of one embodiment of the present invention.

FIG. 2 shows one embodiment of the present invention utilizing a halfwave rectifier. When switch 16 is closed diode 34 halfwave rectifies the 120 volt AC RMS 60 hertz line voltage which is provided by the AC source 10. The capacitors 36 and 38 filter the halfwave rectified waveform for minimum ripple while providing the proper time delays as will be described later. The zener diode 40 clips off the peak voltage such that the circuit is in regulation over normal line voltage fluctuations. A first resistor 42 is selected to provide adequate current for regulation at low line voltage. The first resistor 42 and the first capacitor 44 form a low pass RC passive noise filter for high frequency line noise.

As shown in FIG. 2, first resistor 42 is connected between switch 16 and a first junction point 46. The first capacitor 44 is connected between the first junction point 46 and the second conductor 14. The diode 34 is connected between the first junction point 46 and the normally open contacts 20 of the first relay.

When both switch 16 and switch 24 are closed, a recharging or reset circuit is formed that comprises resistor 42, the combined timing capacitance of capacitors 36 and 38 and the coil 32 of the second relay. When switch 24 is closed, coil 26 of the first relay is connected to the first conductor 12 and the second conductor 14 thereby energizing the first relay. This closes the normally open contacts 20 and opens the normally closed contacts 28. With switch 16 closed, current flows through resistor 42 and charges the capacitors 36 and 38. The second relay will energize when the voltage across the coil 32 of the second relay and the corresponding voltage across the capacitors 36 and 38 reach the pick-up voltage of the second relay. The circuit is designed such that the maximum worst case recharge or reset time will be approximately 100 milliseconds. After the circuit has been recharged or reset by opening switch 16 while switch 24 remains closed the timing capacitance comprised of capacitors 36 and 38 will discharge through the coil resistance of the coil 32 of the second relay, and the voltage will decrease to the drop-out voltage of the second relay. The time required for the timing capacitance to discharge enough to cause the second relay to drop out will range from approximately 2.0 to 4.0 seconds.

During normal application operation, after the circuit has recharged or reset, switch 16 is released and followed as quickly as possible by the release of switch 24. When switch 24 is opened, the first relay drops out causing the normally open contact 20 to open and the normally closed contact 28 to close. When the normally closed contact 28 closes, the charge on the timing capacitance comprised of capacitors 36 and 38 is drained very rapidly through a second resistor 48 which is connected between the normally closed contacts 28 and the second conductor 14. This gives a time delay which reflects conditions associated with punch press operation. If switch 16 is closed and switch 24 is alternately open and closed, the second relay will follow the switch 24 by energizing and de-energizing. If switch 16 is opened and if switch 24 is opened, reconnecting switch 16 will not cause the second relay to energize due to normally open contacts 20 of the first relay remaining open.

Figure 3:
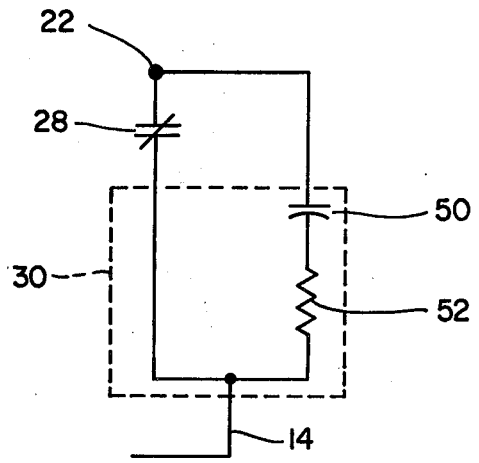
FIGS. 3, 4 and 5 are schematic drawings of alternative embodiments of the present invention detailing a portion of the circuitry.
Figure 4:
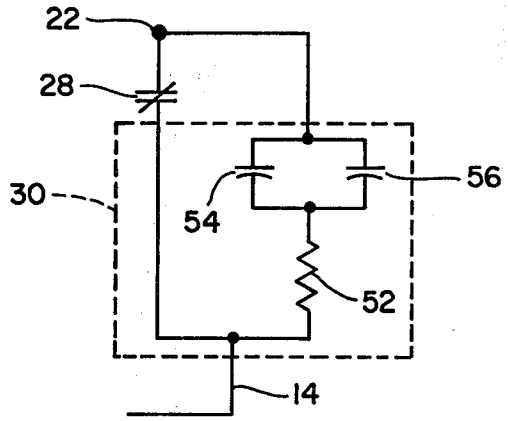
Figure 5:
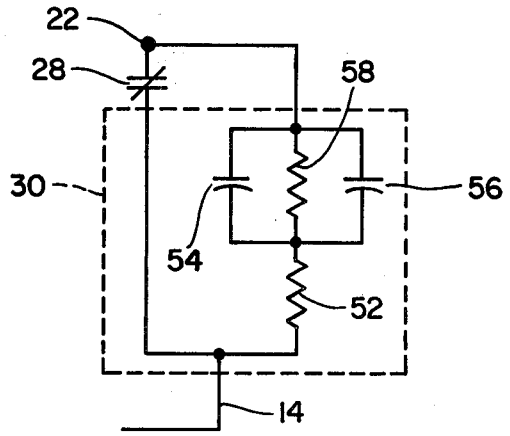

The timing abort means 30 shown in FIG. 1 comprises resistor 48 and capacitors 36 and 38 in FIG. 2. FIGS. 3, 4 and 5 illustrate alternative embodiments of the timing abort means 30.

FIG. 3 is an alternative embodiment of the timing abort means 30 wherein the timing abort means 30 comprises a direct connection between normally closed contacts 28 and the second conductor 14, and capacitor 50 in series with resistor 52 is connected between the second junction point 22 and the second conductor 14. However, by placing the resistor 52 in this position, a slightly longer reset time results as compared with the use of resistor 48, as was shown in FIG. 2. FIG. 4 illustrates a further alternative embodiment in which capacitors 54 and 56 are placed in parallel and replace capacitor 50 in FIG. 3. FIG. 5 is yet another alternative embodiment which is similar to the embodiment shown in FIG. 4 with the addition of resistor 58 in parallel with capacitors 54 and 56.

Figure 6:
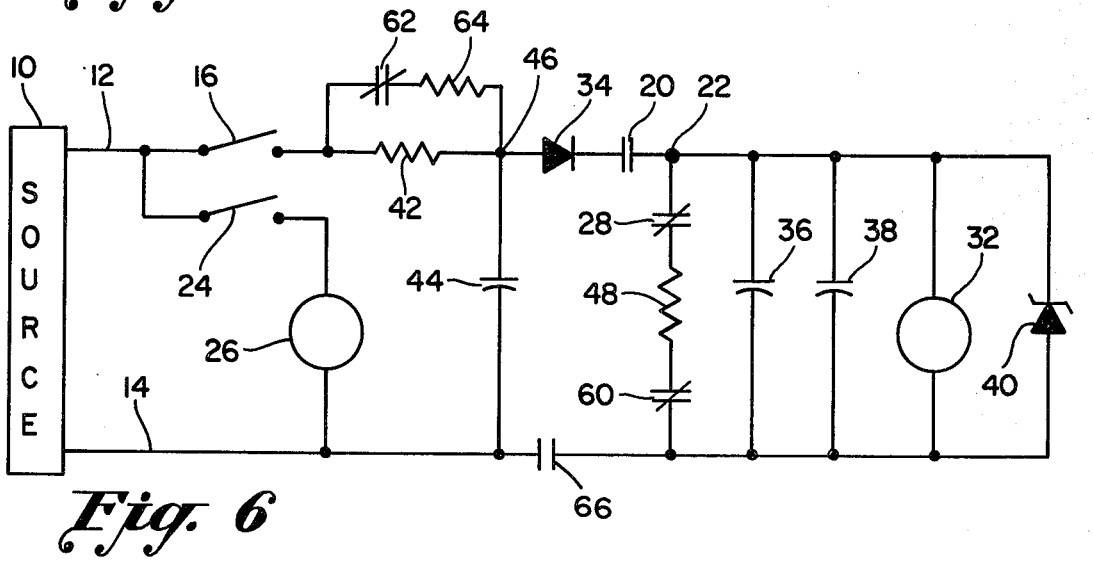
FIG. 6 is a schematic drawing of a preferred embodiment of the present invention.

FIG. 6 shows the preferred embodiment of the present invention. In this embodiment, the first relay has at least two sets of normally open contacts and at least two sets of normally closed contacts. The circuitry of the FIG. 6 embodiment is similar to the circuitry of the FIG. 2 embodiment with the following additional elements.

An additional normally closed contact 60 of the first relay is connected in series between resistor 48 and the second conductor 14. This has the benefit of assuring longer relay contact life for normally closed contacts 28 and 60.

An additional normally closed contact 62 of the second relay is connected in series with a resistor 64, and the two elements are connected in parallel with resistor 42. By adding the normally closed contact 62 and resistor 64, the recharge or reset time of capacitors 36 and 38 is reduced. In the reset mode, when switch 16 is closed and switch 24 is open, resistors 64 and 42 are placed in parallel. Parallel combination of these resistors reduces the resistance through which capacitors 36 and 38 must charge. Therefore, the reset time is reduced proportionately with the decrease in the resistance. As soon as the second relay energizes, the normally closed contact 62 of the second relay opens and only resistor 42 is in the circuit.

An additional normally open contact 66 of the first relay is connected in the common line 14 of the circuit between the AC and DC circuits to further isolate the DC circuit from the AC when switch 24 is opened.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An abort cycle timer circuit connected to an AC source of electrical power having first and second conductors and providing an AC electrical signal and for operating electrical equipment, said circuit comprising:

a means for providing a substantially DC voltage and current;

a first relay having at least one set of normally open contacts and at least one set of normally closed contacts, said normally open contacts connected between said means for providing a DC voltage and current and a junction point, and one of said normally closed contacts connected to said junction point;

a first means for causing an open circuit connected in series between the first conductor and said means for providing a DC voltage and current;

a second means for causing an open circuit connected in series with a coil of said first relay between the first conductor and the second conductor; and, a timing abort means for operating a coil of a second relay and connected to said normally closed contacts of said first relay, said junction point and the second conductor, said coil of said second relay connected between said junction point and the second conductor, said second relay having normally open and/or normally closed contacts.

2. The circuit described in claim 1 wherein a zener diode for clipping the substantially DC voltage and current is connected between said junction point and the second conductor.

3. The circuit described in claim 1 wherein said means for providing a DC voltage and current is a halfwave rectifier.

4. The circuit described in claim 1 wherein said means for providing a DC voltage and current is a fullwave bridge.

5. The circuit described in claim 1 wherein said timing abort means comprises a resistor connected between said normally closed contacts of said first relay and the second conductor, and a timing capacitor connected between said junction point and the second conductor.

6. The circuit described in claim 5 wherein said timing capacitor comprises at least two capacitors connected in parallel.

7. The circuit described in claim 1 wherein said timing abort means comprises a short circuit between said normally closed contacts of said first relay and the second conductor and a timing capacitor connected in series with a resistor between said junction point and the second conductor.

8. The circuit described in claim 7 wherein said timing capacitor comprises at least two capacitors in parallel.

9. An abort cycle timer circuit connected to an AC source of electrical power having first and second conductors and providing an AC electrical signal and for operating electrical equipment, said circuit comprising:

a first means for causing an open circuit and a first resistor connected in series between the first conductor and a first junction point;

a first capacitor connected between said first junction point and the second conductor;

a first relay having at least one normally open contact and at least one normally closed contact and having its coil connected in series with a second means for causing an open circuit, said coil and said second means connected between the first and second conductors;

a diode for rectifying the AC electrical signal and said normally open contacts of said first relay connected in series between said first junction point and a second junction point;

a second resistor connected in series with said normally closed contacts of said first relay, said second resistor and said normally closed contacts connected between said second junction point and the second conductor;

a timing capacitor connected between said second junction point and the second conductor;

a second relay having normally open contacts and/or normally closed contacts with its coil connected between said second junction point and the second conductor; and, a zener diode for clipping the rectified AC electrical signal and connected between said second junction point and the second conductor.

10. The circuit described in claim 9 wherein said timing capacitor comprises at least two capacitors in parallel.

11. An abort cycle timer circuit connected to an AC source of electrical power having first and second conductors and providing an AC electrical signal and for operating electrical equipment, said circuit comprising:

a first means for causing an open circuit and a first resistor connected in series between the first conductor and a first junction point;

a first capacitor connected between said first junction point and the second conductor;

a first relay having at least one set of normally open contacts and at least one set of normally closed contacts and having its coil connected in series with a second means for causing an open circuit, said coil and said second means connected between the first and second conductors;

a diode for rectifying the AC electrical signal and said normally open contacts of said first relay connected in series between said first junction point and a second junction point, and said normally closed contacts of said first relay connected between said second junction point and the second conductor;

a timing capacitor connected in series with a second resistor connected between said second junction point and the second conductor;

a second relay having normally open contacts and/or normally closed contacts with its coil connected between said second junction point and the second conductor; and, a zener diode for clipping the rectified AC signal connected between said second junction point and the second conductor.

12. The circuit described in claim 11 wherein said timing capacitor comprises at least two capacitors in parallel.

13. An abort cycle timer circuit connected to an AC source of electrical power having first and second conductors and providing an AC electrical signal and for operating electrical equipment, said circuit comprising:

a first means for causing an open circuit and connected to the first conductor;

a first resistor connected between said first means for causing an open circuit and a first junction point;

a first capacitor connected between said first junction point and the second conductor;

a first relay having at least one set of normally open contacts and at least two sets of normally closed contacts and having its coil in series with a second means for causing an open circuit and connected between the first and second conductors;

a diode for rectifying the AC electrical signal and said normally open contacts of said first relay connected in series between said first junction point and a second junction point;

a timing capacitor connected between said second junction point and the second conductor;

one of said normally closed contacts of said first relay in series with a second resistor in series with another of said normally closed contacts of said first relay, all connected between said second junction point and the second conductor;

a second relay having at least one set of normally closed contacts with its coil connected between said second junction point and the second conductor;

said normally closed contacts of said second relay in series with a third resistor and both connected between said first means for causing an open circuit and said first junction point; and, a zener diode for clipping the rectified AC signal, said zener diode connected between the second junction point and the second conductor.

14. The circuit described in claim 13 wherein said timing capacitor comprises at least two capacitors in parallel.

* * * * *